US005720782A

United States Patent [19]

Schilowitz et al.

[11] Patent Number: 5,720,782

[45] Date of Patent: Feb. 24, 1998

[54] ADDITIVE CONCENTRATE FOR USE WITH GASOLINES

[75] Inventors: Alan Mark Schilowitz, Highland Park, N.J.; Iain More, Abingdon, United Kingdom

[73] Assignee: Exxon Research and Engineering Company, Florham Park, N.J.

[21] Appl. No.: 615,263

[22] PCT Filed: Sep. 9, 1994

[86] PCT No.: PCT/GB94/01972

§ 371 Date: Aug. 26, 1996

§ 102(e) Date: Aug. 26, 1996

[87] PCT Pub. No.: WO95/07960

PCT Pub. Date: Mar. 23, 1995

[30] Foreign Application Priority Data

Sep. 13, 1993 [GB] United Kingdom ..... 9318908

[51] Int. Cl.[6] ..... C10L 1/14; C10L 1/16

[52] U.S. Cl. ..... 44/300

[58] Field of Search ..... 44/300

[56] References Cited

U.S. PATENT DOCUMENTS

| | | | |
|---|---|---|---|
| 2,904,493 | 9/1959 | Hartzband | 208/17 |
| 3,877,887 | 4/1975 | Moore et al. | 44/438 |
| 4,022,589 | 5/1977 | Alquist et al. | 44/432 |
| 4,155,718 | 5/1979 | Graiff | 44/359 |
| 4,515,740 | 5/1985 | Schuettenberg et al. | 44/308 |
| 4,639,255 | 1/1987 | Schuettenberg et al. | 44/342 |
| 4,929,795 | 5/1990 | Cody et al. | 585/739 |
| 4,937,399 | 6/1990 | Wachter et al. | 585/749 |
| 5,059,299 | 10/1991 | Cody et al. | 208/27 |
| 5,149,452 | 9/1992 | MacAlpine et al. | 508/469 |
| 5,229,021 | 7/1993 | Pillon et al. | 508/469 |
| 5,352,374 | 10/1994 | Habeeb et al. | 508/435 |
| 5,466,364 | 11/1995 | Kaul et al. | 208/307 |
| 5,558,807 | 9/1996 | Kim | 508/251 |

FOREIGN PATENT DOCUMENTS

| | | |
|---|---|---|
| 0321307 | 6/1989 | European Pat. Off. . |
| 0441014 | 8/1991 | European Pat. Off. . |
| 0460957 | 12/1991 | European Pat. Off. . |
| 1486144 | 9/1977 | United Kingdom . |
| 91/12303 | 8/1991 | WIPO . |
| 93/04147 | 3/1993 | WIPO . |

OTHER PUBLICATIONS

PCT/GB94/01972, International Search Report, Exxon Research & Engineering Co., Jan. 1995.

PCT/GB94/01972, International Preliminary Examination Report, Exxon Research & Eng. Co., Oct. 1995.

*Primary Examiner*—Ellen M. McAvoy

*Attorney, Agent, or Firm*—Susan Fletcher Watts; Joseph J. Allocca

[57] ABSTRACT

Hydrocarbon liquids obtained from the isomerization of slack wax have been found to be superior carrier fluids for additives (e.g., detergents) used in gasolines. They produce reduced amounts of engine deposit and mitigate any tendency to cause or promote valve sticking.

15 Claims, No Drawings

ADDITIVE CONCENTRATE FOR USE WITH GASOLINES

The present invention relates to an additive concentrate for use with gasoline, used in gasoline-fuelled engines.

Certain chemicals, termed "additives" are included in gasoline to enhance its properties, combustion characteristics and the resulting combustion products.

Some additives cannot be directly incorporated into gasoline. They may not be readily soluble or dispersible in gasoline. They may also be less effective or have an adverse effect on engine components during use of the gasoline. For example, some additives may leave a sticky residue on intake valves. Accordingly, such additives may be dissolved and/or dispersed in a carrier fluid to form an additive concentrate, and the concentrate is added to or blended with the gasoline. A common carrier fluid is a mineral oil fraction such as a neutral lubricating oil basestock, e.g. S600N.

Carrier fluids can also have an adverse effect on the properties of gasolines into which they are blended. For example, they can increase the amount of combustion chamber deposits in an engine.

It has now been found, in accordance with the discovery forming the basis of this invention, that a hydrocarbon liquid made by the isomerisation of wax can act as a carrier fluid for additives which is less subject to the problems and/or drawbacks of previous types of carrier fluids.

It is known, e.g. from GB-A-1,538,578 to use waxy materials which may include wax isomerates as components of pour point depressant additive combinations in diesel fuels and heating oils. Pour point depressants are not normally added to gasolines.

In one aspect, the invention provides an additive concentrate comprising at least one additive for gasoline dispersed and/or dissolved in a hydrocarbon carrier fluid of which at least a component is a wax isomerate made by the isomerising of wax in the presence of a wax isomerisation catalyst.

In another aspect, the invention provides a novel use of a hydrocarbon liquid made by the isomerisation of wax, wherein the said hydrocarbon liquid is employed as a carrier fluid for at least one additive used or useful in gasoline.

It has been found that hydrocarbon liquid obtained by wax isomerisation serves as an effective carrier fluid for gasoline additives, and does not produce as much deposit in the combustion chambers of gasoline engines as previous carrier fluids.

Preferably, the isomerised wax hydrocarbon liquid, herein referred to as "wax isomerate" or "isomerate" for brevity, has a viscosity at 100° C. in the range of from 4 to 12, more preferably 4 to 8 $mm^2/s$ (cSt), for example, about 6 $mm^2/s$, and a viscosity index (VI) in the range of from 120 to 150, e.g. from 135 to 145.

The isomerate may have been made by the isomerisation of slack wax, and the slack wax may contain up to 15 w % oil, e.g. up to 12 w % oil. The conversion in the wax isomerisation step may be less than 25%, e.g. no more than 20%. The slack wax and/or the isomerate may have been hydrofined to reduce its content of heteroatoms (e.g. oxygen, nitrogen, sulphur) to very low levels.

The wax isomerisation is effected in the presence of a wax isomerisation catalyst, and may be effected in the presence of hydrogen. A suitable catalyst is a Group 8 metal (e.g., a noble metal such as platinum) dispersed on a refractory oxide support (e.g. alumina). The catalyst may contain halogen (e.g. fluorine), associated with the metal and/or the support. A suitable catalyst is platinum dispersed on fluorinated alumina. The catalyst is preferably in the form of particles, preferably having sizes predominantly in the range of from 0.4 to 0.8 mm. The particles may be preformed in this size range or formed in a larger size range and crushed and sieved.

Processes for making wax isomerates suitable for use as carrier fluids for gasoline-additives are described in US patents U.S. Pat. No. 4,937,399 and U.S. Pat. No. 5,059,299.

The additive concentrate may comprise a detergent to reduce the incidence of deposit formation in the intake system of a gasoline engine. The detergent may comprise a polyether amine and/or one or more of the type based on a polyolefin (e.g. polyethylene, polypropylene, polybutylene, including isomers thereof), and copolymers of at least two of the foregoing. Common polyolefin-based detergents include imides (e.g. succinimide) and amines. The latter may be made by chlorinating selected olefins, and reacting the thus-chlorinated olefins with polyamines (e.g., ethylenediamine, tetraethylenepentaamine). A suitable selected olefin is polyisobutene having a molecular weight in the range of from 450 to 1500, more preferably 900 to 1500 (e.g., from 930 to 1400). Another suitable selected detergent may be based on a polyisobutene, preferably of molecular weight in the range of from 450 to 1500, more preferably 900 to 1500, which has been reacted with maleic acid and the resulting acid-functionalised polyolefin thereafter reacted with a polyamine such as tetraethylenepentamine. Processes not involving chlorine are also known. Yet another detergent is a Mannich-base detergent obtained by alkylating phenol with a polyolefin (molecular weight preferably in the range 450 to 1500, more preferably 900 to 1500), and reacting the resulting alkylated phenol with a polyamine and formaldehyde. A detergent of this type is available from Ethyl Chemical Company under the trade name Hi-Tec 4997.

The concentrate may contain other dissolved and/or dispersed additives such as (but not limited to) anti-knock agents, metal-containing valve seat protection (anti-recession) additives, anti-oxidants and demulsifiers, inter alia. The concentrate may also contain other synthetic or mineral oil-derived carrier fluids.

The proportion of carrier fluid in the concentrate (based on total weight of the concentrate) may vary generally from 10 wt. % to 70 wt. %, e.g. 25 wt. % to 60 wt. %, but preferably the proportion of total additive is less than 50 wt. %, e.g. 20 to 30 wt. %, especially where detergent constitutes the sole additive. The dilution factor (concentrate: gasoline) may vary considerably. Commonly this will be about 1:1,000 or 1:2,000. Thus when diluted in gasoline the content of the isomerised wax is preferably not less than 0.015 wt. % (150 wppm), more preferably not less than 0.05 wt. % (500 wppm)..

The invention also provides a gasoline comprising an additive concentrate described herein, and also a method of operating a gasoline fuelled engine employing the additive concentrate or a gasoline comprising the additive concentrate.

The following data illustrate some aspects of the invention.

Two engine test procedures were performed for gasoline engine cleanliness using gasoline having specified amounts of carrier fluid. The deposits on the valves were determined by weighing the valves before and after each of the tests. The first text (test A) was a standard M012E test, and the second test (test B), was of a similar nature to test A, but not identical, and it was performed using a mass-production 1.8 liter gasoline engine.

Test A

M102E Test Data (60 hours continuous engine running in each run):

| Run No | Detergent/ wppm | Carrier Fluid/wppm | Deposit/ valve (mg) | Combustion Chamber Deposit/Cylinder (mg) |
|---|---|---|---|---|
| 1 | None | None | 252,320 | 1576,1283 |
| 2 | PIB amine/275 | None | 55 | 1654 |
| 3 | PIB amine/275 | S600N/800 | 2 | 2282 |
| 4 | PIB amine/275 | EXXSYN/800 | 21.25,–5.0 | 1854/2008 |

Test B 1.8 liter Test Data (60 hours continuous engine operation in each run):

| Run No | Detergent/wppm | Carrier Fluid/ wppm | Combustion Chamber Deposit/ Cylinder (g) |
|---|---|---|---|
| 1 | None | None | 0.534, 0.569, 0.709 |
| 2 | PIB amine/275 | S600N/550 | 1.346 |
| 3 | PIB amine/275 | S600N/800 | 1.323 |
| 4 | PIB amine/275 | EXXSYN/800 | 0.974/1.099 |

Notes to Tests A and B

PIB amine is the reaction product of a polyisobutylene of molecular weight 950 with ethylenediamine.

S600N is a solvent extracted neutral oil of viscosity 600 SUS at 100° F. (37.8° C.).

EXXYSN is the Trade Mark for a series of oils obtained by the isomerisation of wax, generally according to U.S. Pat. No. 5,059,299. The EXXYSN used in Tests A and B had a viscosity of 5.8 cSt (5.8 $mm^2/s$) at 100° C., a VI of 142 and a pour point of –21° C.

In Test A, run 4, the amount of valve deposit recorded as the second test result is minus 5 mg indicating that the valve after the test weighed 5 mg less than before the test. In all the tests, the valves would have lost some material due to wear, but in this test, the amount of deposit formation was so low that the valve wear became apparent.

It is clear from the foregoing test data that the use of a wax isomerate carrier fluid for the detergent reduces the amount of valve deposit formation in a gasoline-fuelled engine. Moreover, there were no indications of valve sticking during either of the runs 4 of tests A and B. Furthermore, lower combustion chamber deposits were produced with the wax isomerate carrier fluid than with the S600N carrier fluid.

A further test of 100 hours continuous operation was performed in a representative mass-production gasoline fuelled engine wherein the gasoline fuel contained 275 wppm PIB amine in 800 wppm EXXSYN carrier fluid of the same type as used in tests A and B. No signs of valve-sticking were apparent.

Although the invention has been described with reference to specific exemplifications, it is to be understood that the invention is not restricted thereto but includes all embodiments falling within the scope of the definitions of the invention herein and within the scope of the claims. For example, the carrier fluid may also comprise synthetic oil fluids (e.g. polyisobutylenes, preferably of molecular weight in the range of from 200 to 2,000—e.g. from 300 to 1000) and/or mineral oil fluids. Moreover, the additives are not restricted to those described supra. For example, they could be, or include, other additives, such as polyetheramines.

We claim:

1. A gasoline additive concentrate comprising at least one additive for gasoline dispersed and/or dissolved in a hydrocarbon carrier fluid of which at least a component is made by the isomerization of wax.

2. The gasoline additive concentrate of claim 1 wherein the wax isomerisate hydrocarbon liquid has a viscosity at 100° C. in the range of from 4 to 12 $mm^2/s$ (cSt) and a viscosity index in the range of from 120 to 150.

3. The gasoline additive concentrate of claim 2 wherein the wax isomerisate liquid is made by contacting a wax with an isomerisation catalyst, in the presence of hydrogen, to cause less than 25% conversion.

4. The gasoline additive concentrate of claim 1, 2 or 3 wherein the additive is selected from detergents, anti-knock agents, metal-containing valve-seat protection agents, anti-oxidants.

5. The gasoline additive concentrate of claim 4 wherein the detergent is selected from or comprises one or more of polyetheramines, polyolefin-amines, polyolefin-polyamines, polyolefin-phenol-polyamines, polyolefin succinimides, (wherein the term polyolefin include copolymers), wherein the polyolefin moiety has a molecular weight in the range of from 450 to 1500.

6. The gasoline additive concentrate of claim 1, 2 or 3 containing from 25 to 60 wt. % of said carrier fluid based on total weight.

7. The gasoline additive concentrate of claim 4 containing from 25 to 60 wt % of said carrier fluid based on total weight.

8. The gasoline additive concentrate of claim 5 containing from 25 to 60 wt % of such carrier fluid based on total weight.

9. A gasoline comprising a gasoline additive concentrate comprising at least one additive for gasoline dispersed and/or dissolved in a hydrocarbon carrier fluid of which at least a component is made by the isomerization of wax.

10. A method of operating a gasoline-fueled engine comprising supplying to and combusting in the engine gasoline containing a gasoline additive concentrate comprising at least one additive for gasoline dispersed and/or dissolved in a hydrocarbon carrier fluid of which at least a component is made by the isomerization of wax.

11. A method for providing additives to a gasoline comprising adding to gasoline at least one gasoline additive dissolved and/or dispersed in a carrier fluid comprising a wax isomerate liquid.

12. The method of claim 11 wherein the wax isomerate liquid carrier fluid has a viscosity at 100° C. in the range of from 4 to 12 $mm^2/s$ and a viscosity index in the range of from 120–150.

13. The method of claim 11 or 12 wherein the gasoline additive is selected from detergents, anti-knock agents, metal containing valve-seat protection agents, anti-oxidants.

14. A gasoline comprising a gasoline additive concentrate comprising a gasoline additive selected from detergents, anti-knock agents, metal containing valve seat protection agents and anti oxidants dispersed and/or dissolved on a hydrocarbon carrier fluid of which at least a component is made by the isomerization of wax, said wax isomerate having a viscosity at 100° C. in the range of from 4 to 12 $mm^2/_2$ and a viscosity index in the range of from 120 to 150.

15. A gasoline according to claim 9 or 14 which contains not less than 0.015 wt. % of said wax isomerate hydrocarbon fluid.

* * * * *